US005517844A

United States Patent [19]

Yuan

[11] Patent Number: 5,517,844

[45] Date of Patent: May 21, 1996

[54] METHOD FOR FORMING THREADINGS IN A BUSHING WHICH IS USED TO SECURE A HOSE THEREIN

[76] Inventor: Chin-Chen Yuan, No. 8, Alley 219, Lane 474, Sec. 2, Chungshan Rd., Taping Hsiang, Taichung Hsien, Taiwan

[21] Appl. No.: 303,166

[22] Filed: Sep. 8, 1994

[51] Int. Cl.[6] ..... B21D 51/16

[52] U.S. Cl. ..... 72/325; 72/356; 72/370

[58] Field of Search ..... 72/256, 325, 343, 72/356, 370

[56] References Cited

U.S. PATENT DOCUMENTS 4,301,672 11/1981 Simon ..... 72/260

4,594,874 6/1986 Bononi et al. ..... 72/325

*Primary Examiner*—Lowell A. Larson

*Attorney, Agent, or Firm*—Hamilton, Brook, Smith & Reynolds

[57] ABSTRACT

A method is provided for forming threadings in a bushing and includes (a) providing a die; (b) extruding a tubular bushing made of metallic material into the die; (c) providing a punch member to punch into the bushing to form a first threading therein; (d) pressing down the bushing along the die and again providing the puncher member to punch into the bushing to form a second threading therein; and (e) repeating the step (d) until a plurality of predetermined threadings are formed in the bushing.

3 Claims, 5 Drawing Sheets

METHOD FOR FORMING THREADINGS IN A BUSHING WHICH IS USED TO SECURE A HOSE THEREIN

BACKGROUND OF THE INVENTION

1. Field of Invention

The present invention relates to a method for forming threadings in a bushing which is used to secure a hose therein.

2. Related Prior Art

A conventional method for forming threadings in a bushing is shown in FIGS. 13–15. However, in this manner, the pitches defined between any adjacent two of the threadings formed in the bushing are not equal.

There will be a more complete and sufficient illustration in the detailed description of the preferred embodiments, concerning the conventional method for forming threadings in a bushing.

The present invention has arisen to mitigate and/or obviate the above-mentioned disadvantages of the conventional method for forming threadings in a bushing.

SUMMARY OF THE INVENTION

The primary objective of the present invention is to provide a method for forming threadings in a bushing so as to form a plurality of threadings each of which has an equal pitch with each other.

In accordance with one aspect of the present invention, there is provided a method for forming threadings in a bushing which is connected between a hose and a hose connection so as to secure the hose in the bushing, the method comprising (a) providing a die; (b) extruding a tubular bushing made of metallic material into the die; (c) providing a punch member to punch into the bushing to form a first threading therein; (d) pressing down the bushing along the die and again providing the puncher member to punch into the bushing to form a second threading therein; and (e) repeating the step (d) until a plurality of predetermined threadings are formed in the bushing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 13:
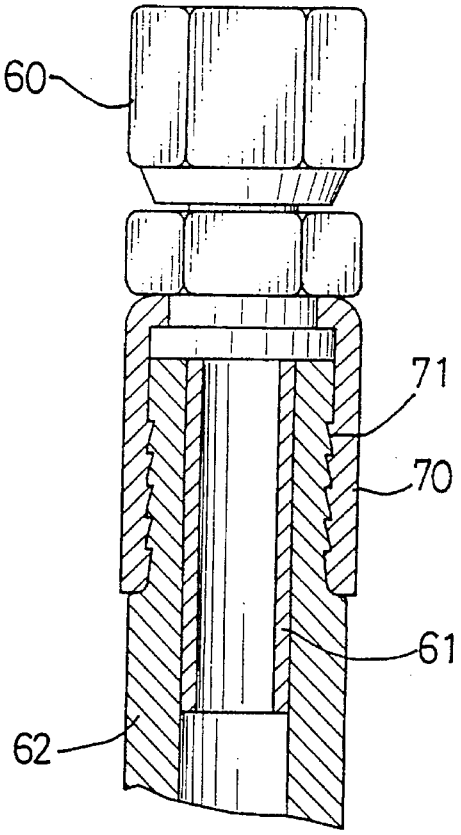
FIG. 13 PRIOR ART
FIG. 13 is a cross-sectional assembly view of a bushing in accordance with the prior art combined with a hose and a hose connection.
Figure 14:
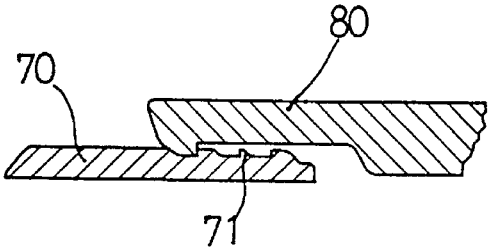
FIG. 14 PRIOR ART
FIGS. 14–15 showing how a conventional method is provided for forming threadings in the bushing as shown in FIG. 13.
Figure 15:
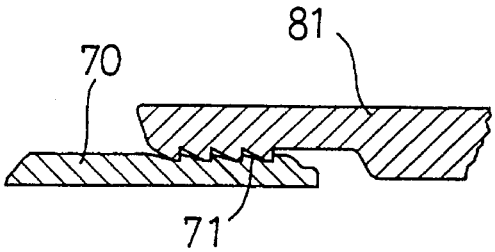
FIG. 15 PRIOR ART

For a better understanding of features and benefits of the present invention, reference is made to FIGS. 13–15, illustrating a conventional method in accordance with the prior art. Referring to FIG. 13, a conventional method is provided for forming a plurality of threadings 71 in a bushing 70 which is connected with a hose connection 60 and is threadedly engaged with a hose 62 in which a connecting tube 61 is sealed, so as to secure the hose 62 in the bushing 70. Referring to FIG. 14, this conventional method comprises providing a cutting tool 80 with one blade to serially cut out a plurality of threadings 71 in the bushing 70. In this manner, the bushing 70 is continuously and repeatedly worked by the blade of the cutting tool 80 to form the plurality of threadings 71, so easily deforming the blade of the cutting tool 80 after long-term utilization during the working process and causing great cost in manufacturing. In addition, the pitches defined between any adjacent two of the threadings 71 are not easily in concert. Referring to FIG. 15, this method further comprises providing a cutting tool 81 with multiple sharp blades to form a plurality of threadings 71 at a time. In this manner, the cutting tool 81 will encounter great resistance due to friction, so easily wearing out the sharp blades thereof. In addition, the depth of each of the threadings is shallow.

Figure 1:
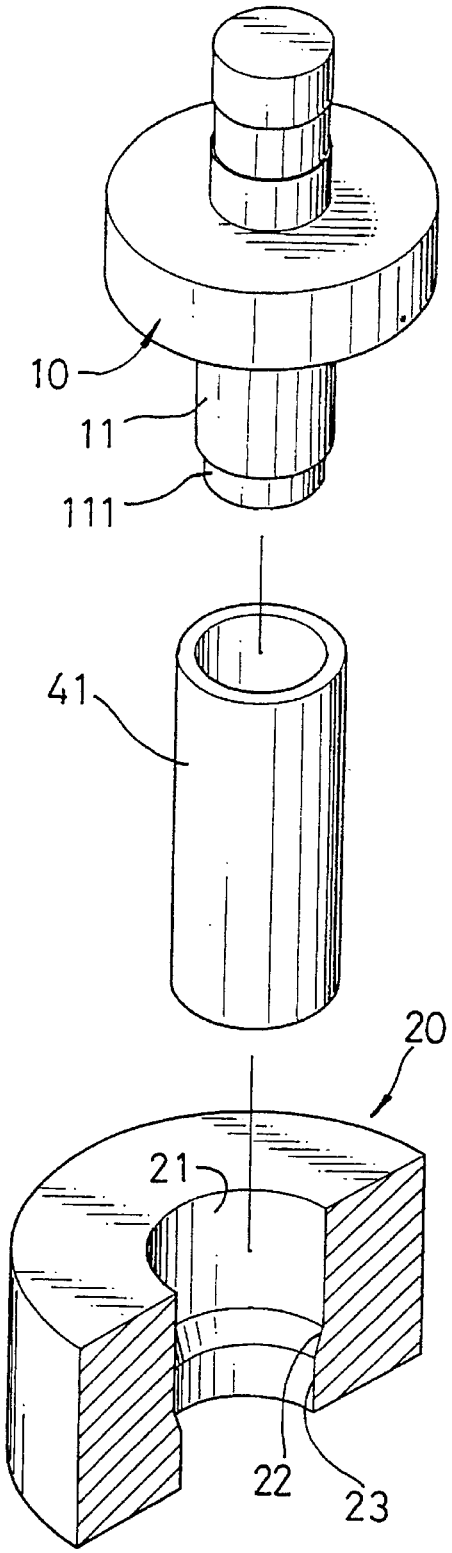
FIG. 1 is an exploded view showing a bushing cooperating with a punch member and a die in accordance with the present invention.
Figure 11:
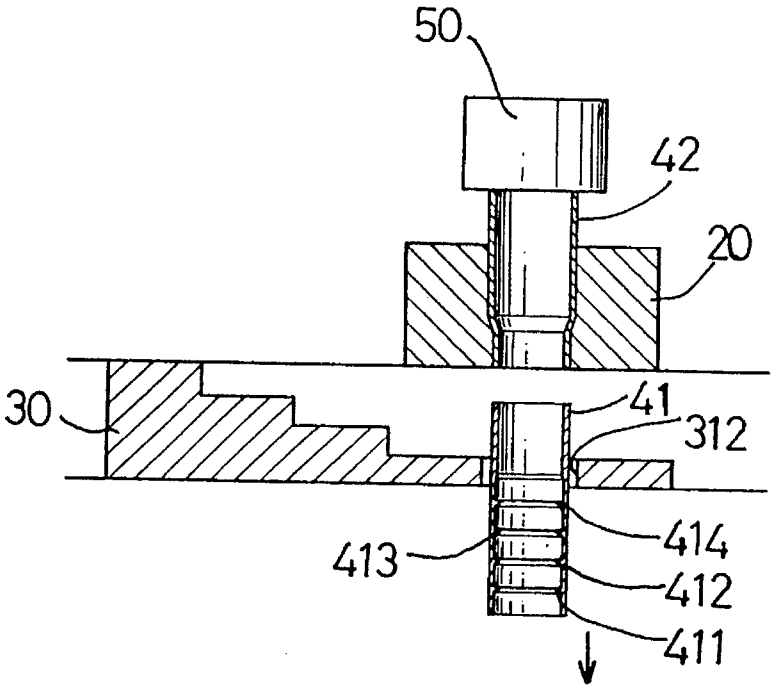
Figure 12:
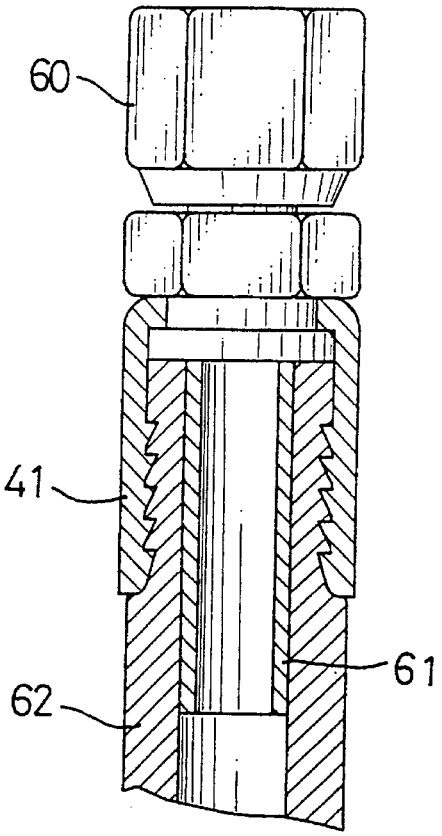
FIG. 12 is a cross-sectional assembly view of the bushing in accordance with the present invention combined with a hose and a hose connection.

Referring to FIGS. 1–12, and initially to FIG. 12, a method in accordance with the present invention is provided for forming a plurality of threadings (not labeled) in a bushing 41 which is connected with a hose connection 60 and is threadedly engaged with a hose 62 in which a connecting tube 61 is sealed, so as to secure the hose 62 in the bushing 41. Referring to FIG. 1, the method comprises (a) providing a die 20; (b) extruding a tubular bushing 41 made of metallic material into the die 20; (c) providing a punch member 10 to punch into the bushing 41 to form a first threading 411 (not shown) therein; (d) pressing down the bushing 41 along the die 20 and again providing the puncher member 10 to punch into the bushing 41 to form a second threading 412 therein; and (e) repeating the step (d) until a plurality of predetermined threadings are formed in the bushing 41.

Again referring to FIG. 1, the die 20 longitudinally defines an upper first passage 21 and a lower second passage 23 therein which communicate with each other, the first passage 21 has a diameter greater than that of the second passage 23 and a tapered surface 22 is formed therebetween. The bushing 41 has an outer diameter equal to the diameter of the first passage 21. The punch member 10 comprises a punch head 11 having an extension portion 111 protruding from an underside thereof, the punch head 11 has a diameter equal to an inner diameter of the bushing 41 and greater than that of the extension 111.

Figure 3:
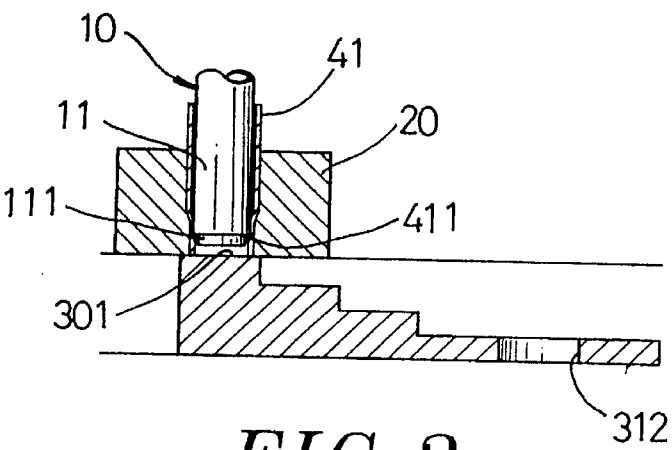
FIGS. 2–11 are operational views showing how to form a plurality of threadings in the bushing.
Figure 2:
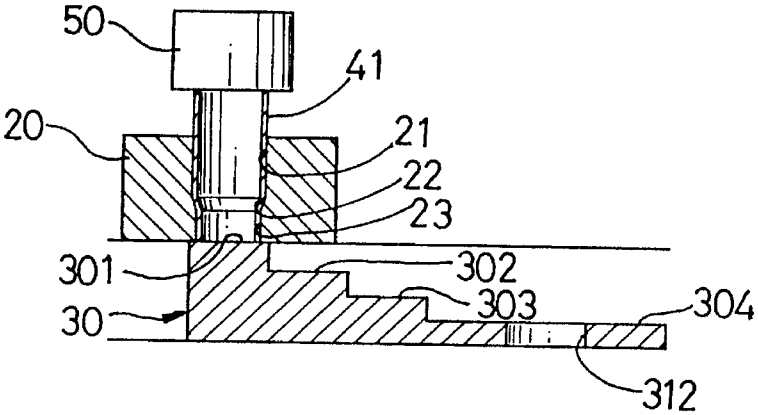

Now, a detailed description of this method is illustrated. Referring to FIGS. 2 and 3, a cross slide 30 is slidably mounted on an underside of the die 20 for biasing against the bushing 41 therein, the cross slide 30 has a first end and a second end and comprises four flat surfaces which are arranged in a stepwise fashion with an uppermost first flat surface 301 at the first end of the cross slide 30 and a lowermost fourth flat surface 304 at the second end thereof, and a distance defined between adjacent two of the flat surfaces is equal. The first flat surface 301 is originally biased against the underside of the die 20, then the bushing 41 is extruded into the die 20 via the first passage 21 thereof by a pressing block 50 and is compressed in the second passage 22 so as to form a configuration as shown in FIG. 2, the pressing block 50 is then removed. The punch head 11 of the punch member 10 is then punched into the interior of the bushing 41 so as to form a first threading 411 (see FIG. 3) therein due to a gap defined between the punch head 11 and the extension 111 thereof.

Figure 5:
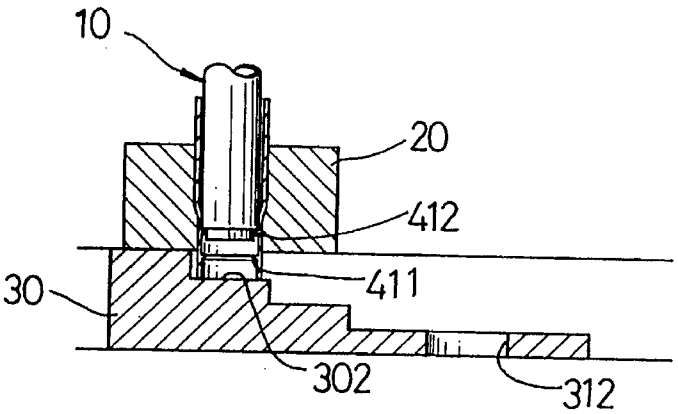
Figure 4:
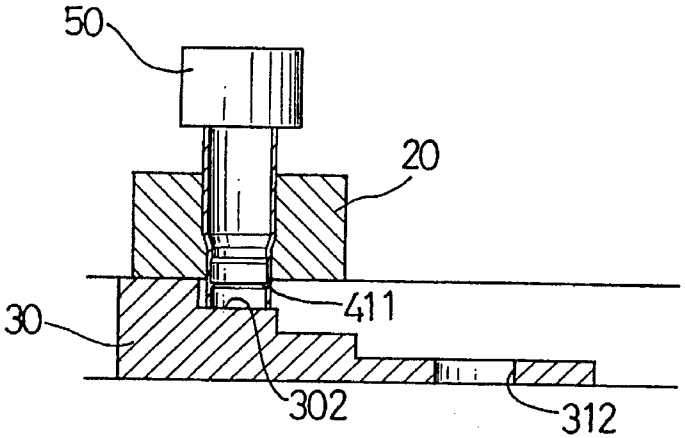
Figure 6:
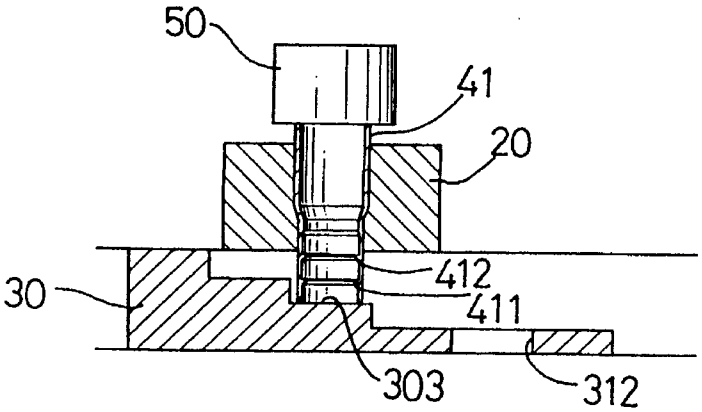
Figure 7:
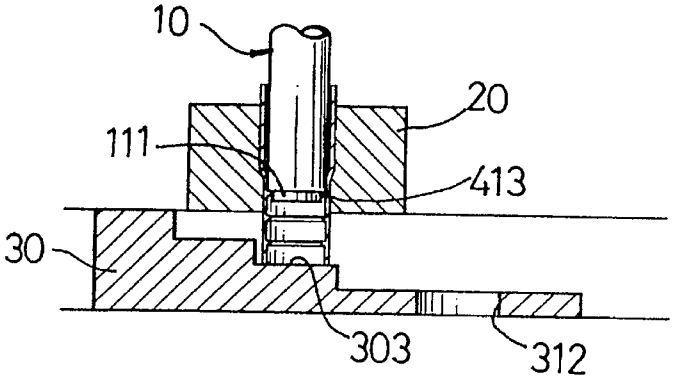
Figure 8:
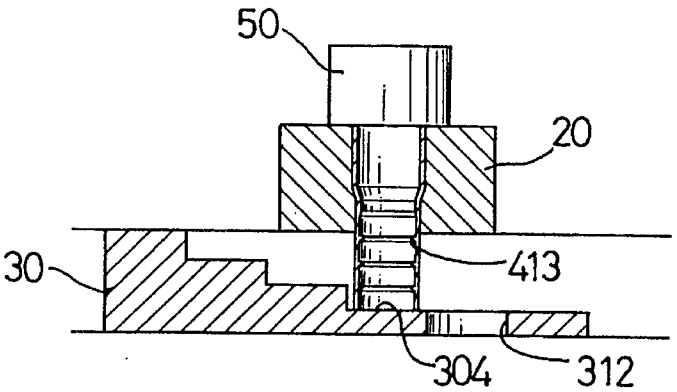
Figure 9:
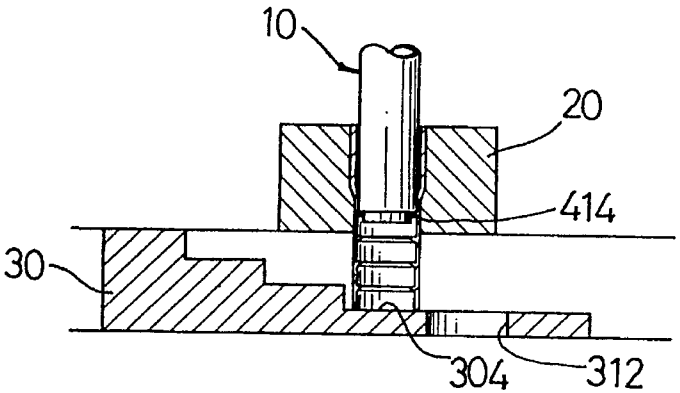

Referring to FIGS. 4 and 5, the cross slide 30 is displaced forward with a second flat surface 302 thereof disposed under said die 20, the bushing 41 is again extruded by the pressing block 50 to move downwardly with an underside thereof abutting against the second flat surface 302 so as to form a configuration as shown in FIG. 4, the pressing block 50 is then removed. The punch head 11 of the punch member 10 is then punched into the interior of the bushing 41 so as to form a second threading 412 (see FIG. 5) therein. In a same manner, referring to FIGS. 6 and 7, the bushing 41 is biased on a third flat surface 303 of the cross slide 30, thereby being formed a third threading 413 thereon, and referring to FIGS. 8 and 9, the bushing 41 is biased on the fourth flat surface 304 of the cross slide 30, thereby being formed a fourth threading 414 thereon. It is to be noted that, the threadings formed in the bushing 41 are spaced at an equal distance and the pitch between adjacent two of the threadings in the bushing 41 is equal to the distance between adjacent two of the flat surfaces of the cross slide 30.

Figure 10:
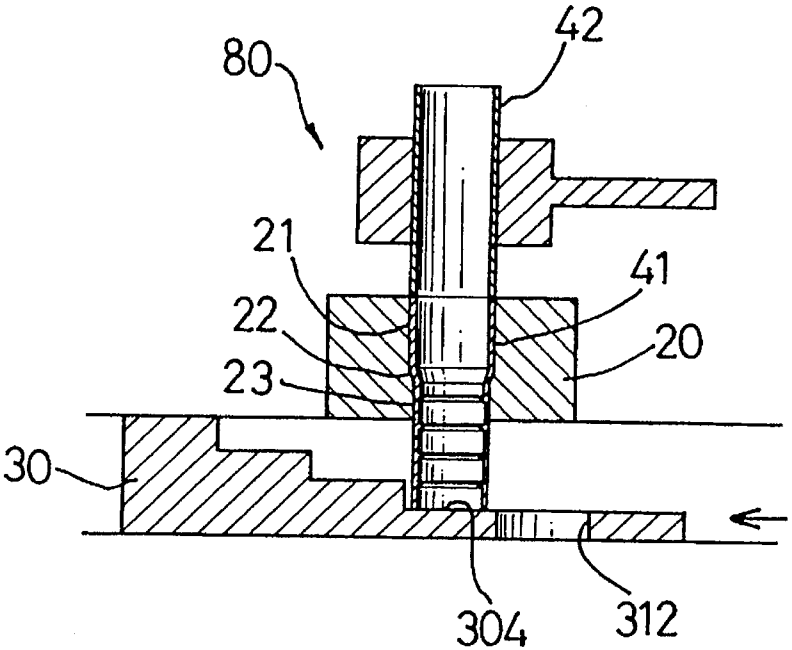

Referring to FIGS. 10 and 11, the fourth flat surface 304 of the cross slide 30 defines a hole 312 therein which has a diameter greater than the outer diameter of the bushing 41. When a plurality of predetermined threadings, e.g. four, are formed in the bushing 41, a clamp device 80 (see FIG. 10) is provided for clamping a second tubular bushing 42 to be forced into the die 20 by the pressing block 50 (see FIG. 11) so as to eject the bushing 41 from the die 20 via the hole 312 of the cross slide 30, thereby continuing forming a plurality of predetermined threadings in the bushing 42 and the ongoing procedure is thus accomplished. Therefore, the bushing 41 is formed with four threadings therein which have an equal pitch with each other.

It should be clear to those skilled in the art that further embodiments of the present invention may be made without departing from the teachings of the present invention.

I claim:

1. A method for forming threadings in a tubular bushing which is connected between a hose and a hose connection so as to secure said hose in said tubular bushing, said method comprising the steps of:

(a) providing a die;

(b) extruding a tubular bushing made of metallic material into said die;

(c) providing a cross slide slidably mounted on an underside of said die and located below said tubular bushing, said cross slide having a first end and a second end and including a plurality of flat surfaces which are arranged in a stepwise fashion with an uppermost flat surface located at the first end of said cross slide and rested on an underside of said tubular bushing and a lowermost flat surface located at the second end thereof;

(d) providing a punch member to punch into said tubular bushing to form a first threading therein;

(e) moving said cross slide such that an adjacent flat surface of said cross slide is located below said tubular bushing and pressing down said tubular bushing along said die so as to be rested on said adjacent flat surface of said cross slide and again providing said punch member to punch into said tubular bushing to form a second threading therein; and (f) repeating said step (e) until a plurality of predetermined threadings are formed in said tubular bushing, wherein a distance defined between two adjacent said flat surfaces of said cross slide is a constant, whereby said predetermined threadings formed in said tubular bushing are spaced at an equal distance and the pitch defined between adjacent two of said predetermined threadings formed in said tubular bushing is equal to the distance between two adjacent said flat surfaces of said cross slide.

2. The method in accordance with claim 1, wherein said die defines an upper first passage and a lower second passage therein which communicate with each other, said upper first passage has a diameter greater than that of said lower second passage and a tapered surface is formed therebetween, said tubular bushing has an outer diameter equal to the diameter of said upper first passage.

3. The method in accordance with claim 1, wherein said punch member comprises a punch head having an extension portion protruding from an underside thereof, said punch head has a diameter equal to an inner diameter of said tubular bushing and greater than that of said extension portion.

* * * * *